US005329884A

United States Patent [19]

Bell

[11] Patent Number: 5,329,884

[45] Date of Patent: Jul. 19, 1994

[54] HARNESS WITH ADJUSTABLE POSITIONING PAD AND TOOL BELT

[76] Inventor: Michael Bell, 1705 Triumphe Way, Warrington, Pa. 18976

[21] Appl. No.: 13,281

[22] Filed: Feb. 4, 1993

Related U.S. Application Data

[63] Continuation-in-part of Ser. No. 893,298, Jun. 4, 1992, Pat. No. 5,228,412.

[51] Int. Cl.[5] ..... A62B 35/00

[52] U.S. Cl. ..... 119/857; 182/3

[58] Field of Search ..... 119/96; 182/3, 4; 244/151 R

[56] References Cited

U.S. PATENT DOCUMENTS

| | | | |
|---|---|---|---|
| 2,661,888 | 12/1953 | Sidlinger | 119/96 |
| 4,923,105 | 5/1990 | Snyder | 224/255 |
| 4,991,689 | 2/1991 | Cole | 182/3 |
| 5,220,976 | 6/1993 | Gunter | 182/3 |

*Primary Examiner*—Robert P. Swiatek

*Attorney, Agent, or Firm*—Caesar, Rivise, Bernstein, Cohen & Pokotilow, Ltd.

[57] ABSTRACT

Harnesses to be worn by persons located at an elevated position for releasable securement to a holding or lowering device to protect the persons from falling. Each harness is formed of interconnected webs of flexible, e.g., nylon, material. Some harnesses include a pair of extendable, flexible, rappelling straps for connection to a holding or lowering device. Some harnesses include a pair of vertically oriented waist belt positioning straps located on the rear of those harnesses for adjusting the height of the waist belt at the rear of the harnesses. Some harnesses includes passageways through portions thereof adjacent the front of those harnesses and through which respective waist belts extend to releasably secure them to the harnesses. The waist belt of various harness includes a positionable tool case thereon. The waist belts of some harnesses each include a positioning pad releasably secured thereto.

25 Claims, 11 Drawing Sheets

HARNESS WITH ADJUSTABLE POSITIONING PAD AND TOOL BELT

BACKGROUND OF THE INVENTION

This application is a continuation-in-part of my U.S. Pat. No. 5,228,412, filed on Jun. 4, 1992, whose disclosure is incorporated by reference herein. This invention relates generally to safety apparatus and more particularly to a harness arranged to be worn by a person to protect him/her from a fall.

As a result of the enactment of various safety laws persons working at elevated height positions, e.g., window washers, telephone lineman, etc., are required to be protected against falls. One common approach to achieve that end is the use of a safety belt which is worn on the worker's waist. The belt is arranged to be worn about the waist of the workman and includes a D-ring or some other metal loop fixedly mounted on the belt in the center of the portion located at the worker's back. The D-ring is arranged to be "tied off" i.e., connected, via a lanyard or some other means, to a supporting member, e.g., a portion of a building or other static structure, a rope grab device mounted on a safety line, etc. Thus, once the worker is tied off should he/she fall off of the platform, scaffolding, or other support on which he/she is working or if that platform etc. itself drops or otherwise falls away, the worker will be prevented from falling to the ground.

While such safety belts are generally suitable for their intended purposes they are not designed to act as a primary means for suspending the person at an elevated position to enable him/her to perform some activity while so suspended. In fact such safety belts are generally incapable of such use since they tend to inhibit the person's mobility, thus interfering with the worker's ability to function efficiently when he/she is tied off.

Harnesses have been developed and sold to serve as a means to distribute the shock load across portions of the body of the wearer for fall protection purposes. Such harnesses typically include straps or loops which are arranged to encircle the wearer's thighs, a belt or some other portion to encircle the wearer's waist, and straps extending over the wearer's shoulders. Such harnesses typically also include at least one connection member, e.g., a D-ring, to enable the harness to be connected to some tie-off means for fall protection purposes.

One type of harness is that disclosed in copending application serial no. PCT/US90/06609, the entire disclosure of which is incorporated by reference herein.

Prior art harnesses have also not adequately addressed the problem of discomfort caused by a waist belt being located in an inappropriate position with respect to the worker's back for the type of work being conducted by the worker. In this regard in some applications, e.g., in the construction industry where workers typically standing on a support surface and are thus vertical, a harness having a waist belt located at the small of the worker's back should not present a discomfort problem irrespective of the length of time the belt is worn at that position. If, however, such a harness is used by a utility worker working at an elevated position on a utility pole wherein the worker is tilted backward from the vertical, a waist belt engaging the small of the worker's back will soon dig-in and become uncomfortable. Thus, for such "utility" applications it is desirable that the waist belt engage the person below the small of his/her back, e.g., engage the upper portion of the buttocks, in the interests of long term comfort.

OBJECTS OF THE INVENTION

Accordingly, it is a general object of this invention to provide a harness which overcomes the disadvantages of the prior art.

It is a further object of this invention to provide a harness including a waist belt for supporting tools or a positioning pad.

It is a further object of this invention to provide a rappelling harness including a waist belt for supporting tools or a positioning pad thereon.

It is still a further object of this invention to provide a harness having a waist belt whose height at the rear of the harness can be readily adjusted.

It is yet a further object of this invention to provide a harness having a waist belt for supporting tools or a position pad thereon and whose height at the rear of the harness can be readily adjusted.

It is yet another object of this invention to provide a rappelling harness having a waist belt for supporting tools or a position pad thereon and whose height at the rear of the harness can be readily adjusted.

SUMMARY OF THE INVENTION

These and other objects of this invention are achieved by providing harnesses formed of a flexible material to be worn by a person, the harnesses include a waist belt, a pair of upper torso straps, and a pair of leg straps. Each of the upper torso straps includes a chest strap portion for extending over a portion of the back of the person, a shoulder strap portion for extending over a respective shoulder of the person, and a back strap portion for extending over a portion of the back of the person. Each of the leg straps is arranged for extending about a respective leg of the person.

In some preferred embodiments of the invention the harnesses includes a pair of rappelling straps.

In some preferred embodiments of the invention the harnesses include waist belt positioning straps. In such embodiments one of the leg straps is connected between a first one of the back strap portions and a first one of the chest strap portions, while the other one of the leg straps is connected between a second one of the back strap portions and a second one of the chest strap portions. One of the waist belt positioning straps is connected in a generally vertical orientation between a first one of the back strap portions and a first one of the leg straps, while the other of said waist belt positioning straps is connected in a generally vertical orientation between a second one of the back strap portions and a second one of the leg straps. The waist belt is coupled to waist belt positioning straps and slidable thereon so that the position of the waist belt at the rear of the harness can be adjusted to a desired height.

In accordance with some aspects of this invention the waist belt comprises a tool belt for slidably supporting a tool holder thereon, and in accordance with other aspects of this invention a positioning belt is releasably secured to the waist belt.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
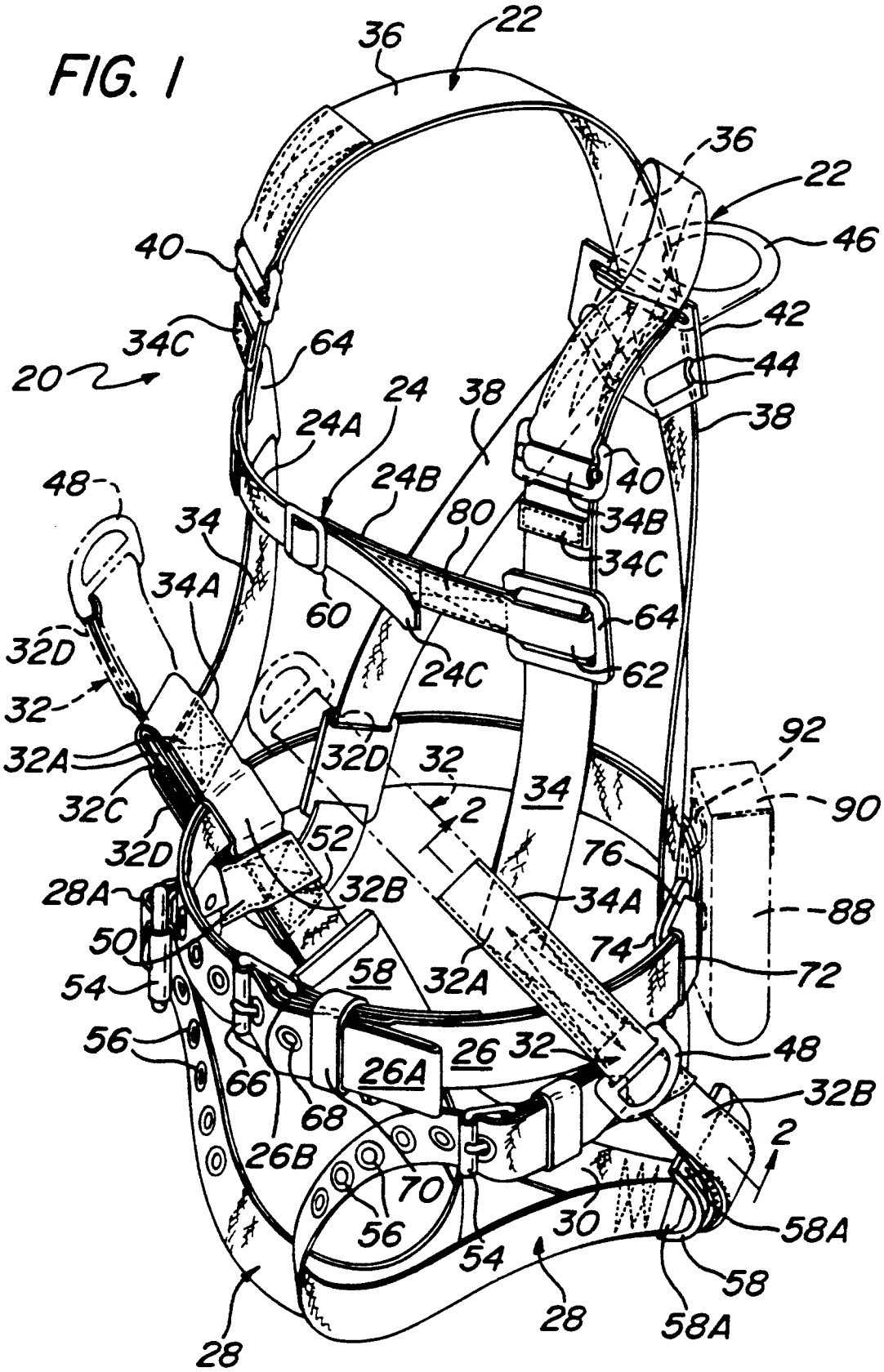
FIG. 1 is an orthogonal view of one embodiment of a harness constructed in accordance with this invention.

Referring now to various Figures of the drawing where like reference numerals refer to like parts there is shown at 20 in FIG. 1, one embodiment of a harness constructed in accordance with this invention.

The harness 20 is arranged to be worn by the person to support/suspend him or her at an elevated position so that he or she can perform some activity thereat, substantially unencumbered or unhindered by the harness, or to connect to it any lowering device for rappelling purposes or to a tie off device for fall prevention purposes.

Figure 2:
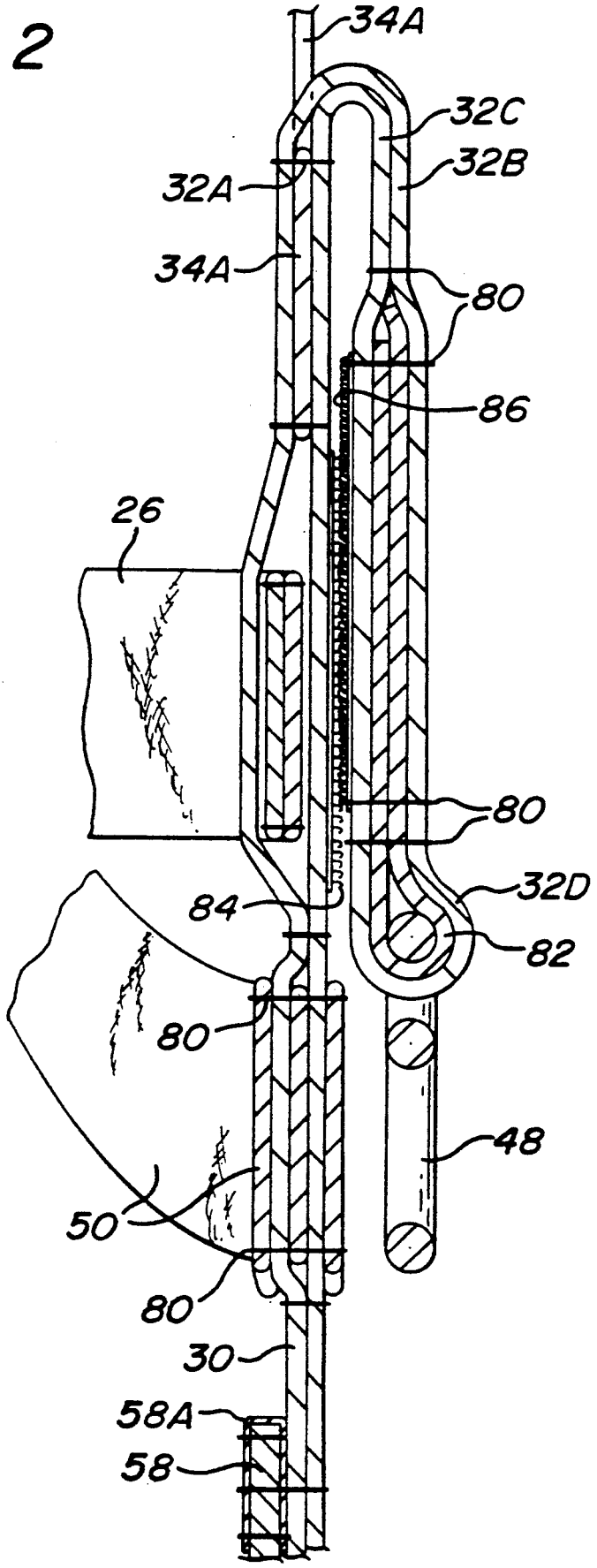
FIG. 2 is an enlarged, sectional view taken along line 2—2 of FIG. 1.

Referring now to FIGS. 1 and 2, the harness 20 comprises a plurality of flexible straps, formed of a high-strength woven plastic or other type material, such as nylon or polyester, which are fixedly secured together, such as by stitching, to form a configuration into which the upper torso and legs of a person (not shown) are held.

The harness basically comprises a pair of upper torso straps 22, a chest strap 24, a waist belt 26, a pair of leg straps 28, a seat strap 30, and a pair of support/rappelling straps 32. Each of the upper torso straps 22 include three portions, namely a chest side-strap portion 34, a shoulder strap portion 36 and a back strap portion 38. Each chest side-strap portion 34 comprises a vertically extending section arranged to extend vertically adjacent a respect side of the wearer's chest when the harness is worn. Each portion 34 is secured, e.g., sewed, at its lower end 34A to a portion 32A of an associated rappelling strap 32. The upper end 34B of each chest side-strap portion 34 terminates in a free end 34C which is folded over itself and sewn. Each free end 34C is arranged to be received within a buckle 40 secured to an associated shoulder strap portion 36, enabling the buckle 40 to adjust the chest side-strap portion 34.

Each shoulder strap portion 36 extends over a respective shoulder of the wearer and merges into an associated back strap portion 38. In fact, in accordance with the preferred embodiment of this invention, each shoulder strap portion and associated back strap portion is formed as an integral unit of a web of the flexible material.

The two back strap portions 38, extend through a cross-buckle 42, formed of any suitable strong material, such as leather or plastic, and having slots 44 therein through which the straps 38 extend and criss-cross in an X-like configuration in the center of the wearer's back, and then extend downward vertically along each side of the wearer's back. A conventional D-ring 46 is secured to the cross-buckle 42 to serve as a means for connecting the harness to some support or lowering device.

The lower end 34A of each chest side-strap portion 34 is fixedly secured, e.g., sewn, to another portion 32A of an associated rappelling strap 32. The details of the rappelling straps 32 will be described later. Suffice it for now to state that each rappelling strap 32 is formed of two webs 32B and 32C (FIG. 2), each composed of the same material as that of the torso straps. The two webs 32B and 32C are sewn together along most of their length (except in a mid-portion area) to form a double thickness rappelling strap. This unsewn mid-portion of each rappelling strap forms a passageway through which a portion of the waist belt 26 passes, to secure the waist belt to the rest of the harness. As described in detail below, this feature enables the waist belt 26 to be replaced with a different style waist belt, containing a waist positioning pad, which is the embodiment shown in FIGS. 3-5 and described in further detail below.

The free end 32D of each rappelling strap includes means for connecting it to some safety device, e.g., a rope grab, a lowering device, etc., by a conventional D-ring 48, which is secured at the free end 32D by folding over the free end and sewing the free end to the rappelling strap.

The two webs 32B and 32C which form the rappelling straps also serve to form other portions of the harness. In particular the web 32B, which is the outermost of the two webs, forms the heretofore identified seat strap 30, and thus extends between the two rappelling straps at the rear of the harness in order to engage the buttocks of the wearer. The other web 32C forms respective extension sections 28A of both of the leg straps 28. Each leg strap 28, also includes a short section 50 which is fixedly secured, e.g., sewn, onto another portion 52 of the rappelling strap 32. The short leg strap section 50 of each leg strap includes a buckle 54 at its free end. The extension section 28A of each leg strap is arranged to be releasably secured to the buckle 54 at the free end of the short leg strap section to form a loop encircling the upper leg of the wearer just below the groin. Thus, the end of the extension section 28A of the leg strap 28 includes a plurality of eyelets 56 therein to permit the adjustment of the size of the loop to comfortably and yet securely fit the wearer's leg.

In order to enhance comfort when the harness is worn, each leg strap includes an enlarged pad 58 formed of a plastic or other materials such as nylon, polyethylene, etc., secured, e.g., sewn, onto the inner surface of the extension section 28 so that it engages the back of the wearer's leg. The pad 58 may be bound at each of its edges by a conventional binding material 58A if desired. Thus the pad has the effect of spreading out the pressure applied by the harness on the back of the wearer's leg. The heretofore identified seat strap 30 further enhances wearer comfort by the spreading some of the pressure across the wearer's buttocks.

The chest strap 24 comprises a pair of narrow right and left sections or webs 24A and 24B, respectively, which are formed of the same material making up the other straps, and which are arranged to be releasably secured together by a buckle 60. One free end of the left section 24B is folded back over itself and sewn to form a loop 62, while the other free end of that section includes the buckle 60 fixedly secured, e.g., sewn, thereon. That buckle serves to connect the two chest strap sections 24A and 24B together. To that end, the right chest strap section 24A includes a free end 24C arranged to be received in the buckle 60. The other free end of the right chest strap section 24B is in the form of a loop (not shown), like the loop 62 of the chest strap section 24B.

The chest strap sections 24A and 24B are arranged to be slidably secured onto an associated side chest side-strap portion, to position the chest strap at any location desired by the wearer. Thus, the loop 62 in the chest strap section 24B is arranged to receive therethrough the chest side strap portion 34, while the loop in the other chest strap section 24A is arranged to receive therethrough the other chest side-strap portion 34. In order to hold the chest strap sections 24A and 24B in the desired vertical position on the chest side-strap portions 34, a pair of slidable buckles 64 are provided. In particular, one slidable buckle 64 is mounted on the chest side-strap portion 34 on the right side, surrounding the portion of the loop 62 of the chest strap web and the portion of the chest-side strap portion extending through that loop. In a similar manner, a second slidable buckle 64 is mounted on the other chest side-strap portion 34 surrounding the portion of the loop of the other chest strap web and the portion of the other side strap portion extending through that loop. As a result of this type of chest strap structure, the chest strap may be removed and replaced as desired.

The waist belt 26 has a free end 26A and a looped end 26B having secured therein a conventional buckle 66 to engage the eyelets 68 for releasable and adjustable securement of the waist belt about the wearer. The waist belt further includes a loop 70 through which the free end 26A of the belt may be retained. The waist belt 26 is releasably retained to the device 20, through a loop 72 formed in the lower portion 38B of each back strap portion 38 when the lower back strap portion 38B passes through a buckle 74 via slots 76.

The rappelling straps will now be discussed in additional detail. As shown in FIG. 1, the device 20 includes a pair of rappelling straps 32 which are movable between a stored position as shown in FIG. 2, to an extended position as shown in phantom in FIG. 1. The rappelling straps 32 are comprised of two webs, outer web 32B (which forms the seat strap) and inner web 32C (which forms the leg straps). Outermost web 32B extends between the two rappelling straps 32, at the rear of the harness in order to engage the buttocks of the wearer. Inner web 32C forms the respective extension sections 28B of both of the leg straps 28.

In the harness 20, a pair of the rappelling straps are used for both additional balance and strength. As can be seen in FIG. 2, each strap 32 has a free end 32D having a conventional D-ring 48 connected thereto, for releasable connection to a lowering means (not shown) or other apparatus. As mentioned earlier, the connector is secured to the free end 32D, by folding over the free end of each extendable strap 32, and securing it in place by stitching 80 (FIG. 2) or other conventional means. As shown in FIG. 2, each of the rappelling straps 32 may include an internally contained stiffening member 82 located adjacent the free end 32D of the straps and which is sewn into place when the D-ring is sewn onto free end 32D. This stiffening member 82 aids the user in being able to extend the straps when desired, as discussed below and may be comprised of the same material as that of webs 32C and 32B.

The extendable/retractable rappelling straps 32 include on one side of their inner web 32B, the hook component 84 of a VELCRO fastening system. The other cooperating loop component 86 of the VELCRO fastening system is secured to the front face of each of the inner webs 32B. Thus, while wearing the harness, each rappelling strap 32, can be held tightly against the harness in a normal or stowed position. This ensures that the straps do not interfere with the wearer's activities or present any tangling hazard. However, when it is desired to connect the harness 20 to a lowering device, rope or other apparatus, the two extendable rappelling straps 32 can be peeled away from the harness so that they extend therefrom but are fixedly connected to the harness at their lower end 32A. Once extended, they may be easily connected to whatever support means are desired, e.g., a lowering or rappelling device.

In addition, the device 20, may include a storage compartment or pouch 88, which comprises a pocket or bolster type construction having an upper flap 90 which is releasably secured to the bolster to insure that none of the components held within the compartment fall out. The rear of the pouch is most easily secured to the harness 20 by placing the loop 92 through the waist belt 26. The loop 92 may be secured to the rear of the pouch by conventional means such as stitching or by a closure device such as a snap closure device (not shown). Although it is preferable that the pouch 88 be secured below the waist strap 26 to minimize interference with a worker, it should be readily apparent to one skilled in the art that it may be secured in any appropriate manner and place. The flap 90 may be held in place by any releasable securement means, such as VELCRO strips. This compartment is particularly suited for storing connectors or a conventional descent lowering device, etc., but can be used to hold anything that might be desired by the user and which could fit therein.

Figure 4:
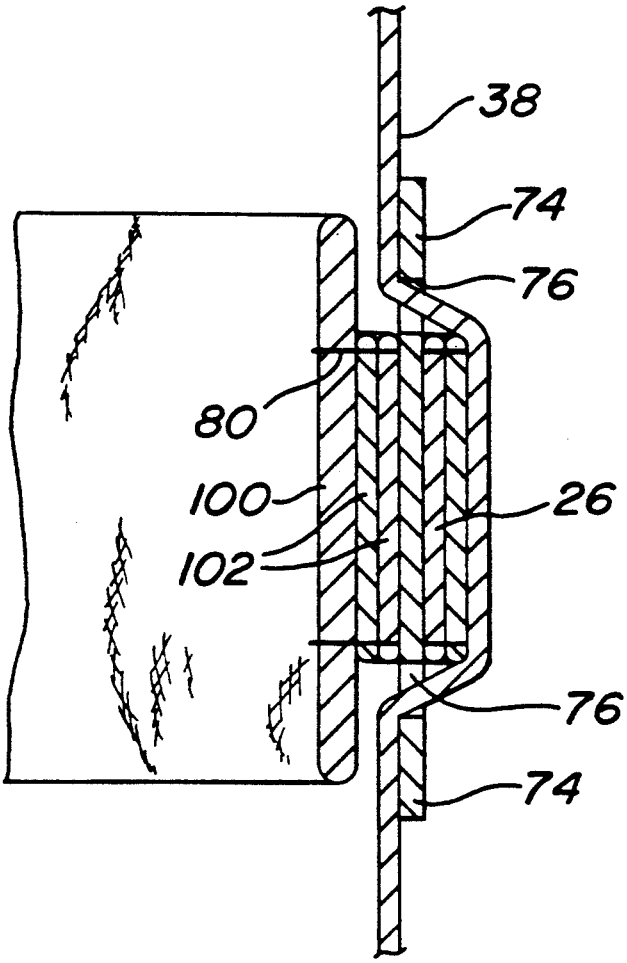
FIG. 4 is an enlarged, sectional view taken along line 4—4 of FIG. 3.
Figure 5:
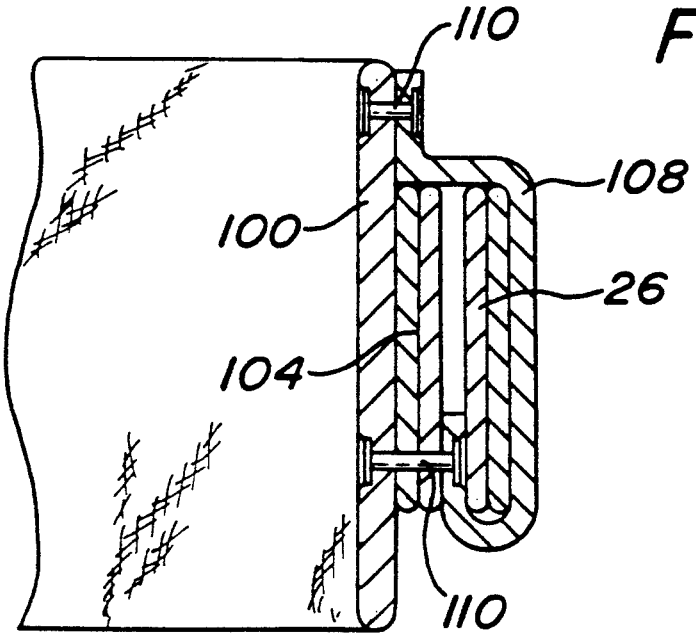
FIG. 5 is an enlarged, sectional view taken along line 5—5 of FIG. 3.

The second preferred embodiment of the present invention will now be discussed with reference to FIGS. 3–5. The harness 200 of the second embodiment is similar to harness 20, except with respect to the waist belt features which now additionally comprise a positioning pad. Common reference numerals are used with respect to common parts in both embodiments in the interest of brevity.

Figure 3:
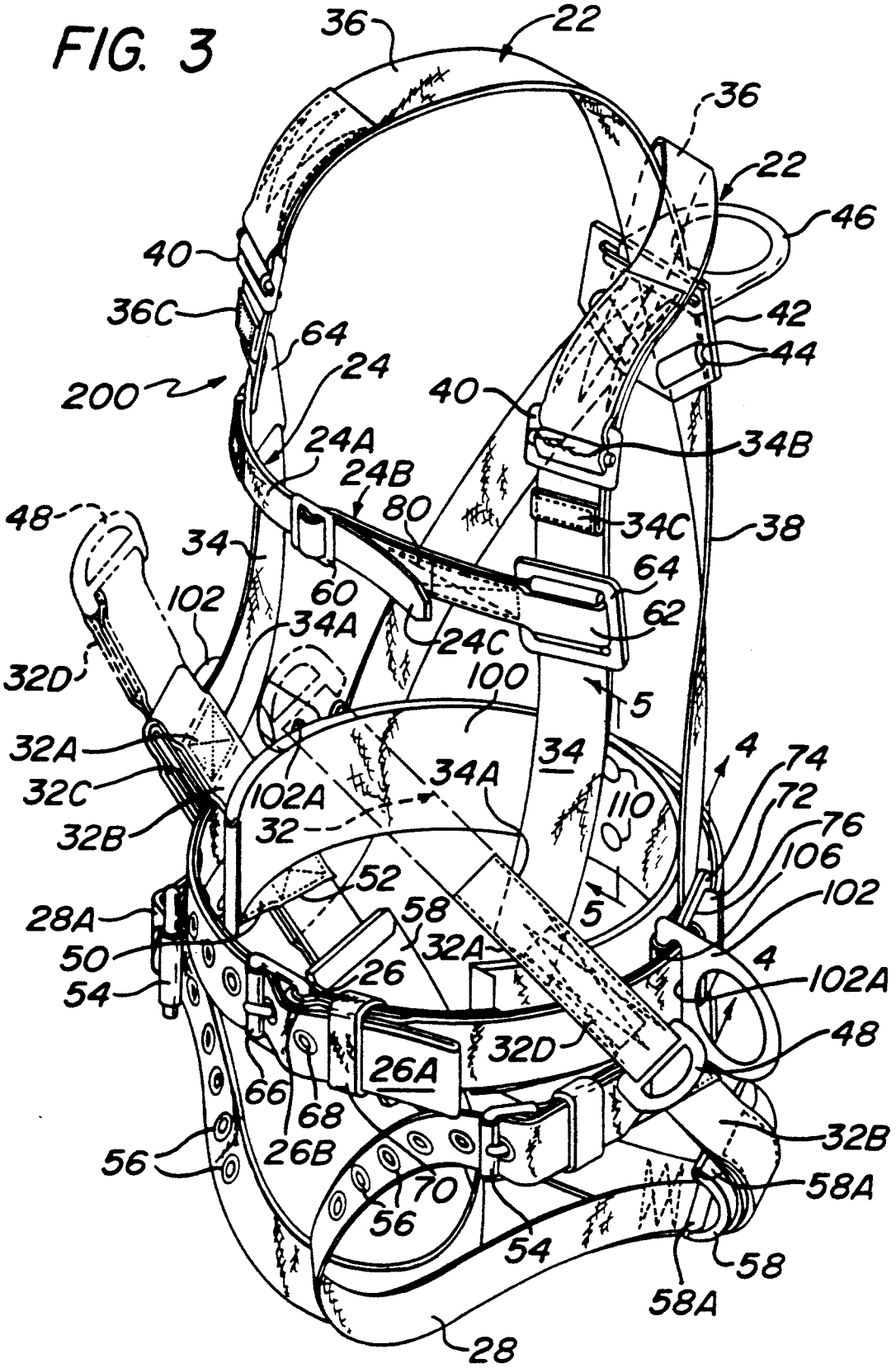
FIG. 3 is an orthogonal view of a second embodiment of a harness constructed in accordance with this invention.

As shown in FIG. 3, the harness 200 comprises the waist positioning pad 100 which is a modular unit having secured adjacent each end on the rear side thereof, a conventional D-shaped connector 102. The positioning pad 100 may be secured to the harness 200 if desired and easily removed due to its modular construction. To that end, securement of the positioning pad 100 will be discussed with respect to FIGS. 4 and 5. As shown in FIG. 4, the pad 100 is sewn onto a strip of webbing 104 which has loops 106 (FIG. 3) formed at each end when the webbing 104 is folded over and stitched to the rear of the pad. Each of these loops. 106 retains the D-shaped connectors 102 therein which are in part, utilized to retain the modular positioning pad unit to the waist belt as described in detail hereinafter. The connectors are retained within the loops at the appropriate site by the stitching 80 of the webbing 104. At approximately the center of the positioning pad 100, a loop of material 108 is riveted to the pad 100 and the webbing 104 via rivets 110 to enable the waist belt 26 to pass through and be retained by loop 108. The positioning pad structure is easily added to the overall harness structure. For example, the free end of the waist belt 26 is threaded through the unsewn mid-portion passageway of a rappelling straps 26. Thereafter the free end is threaded through the through the slot 102A of D-connector 102 (FIG. 3) located on webbing 104, through the loop 106 and thereafter through the slot of a second identical D-connector located in the loop 106 of webbing 104. Thereafter, the waist belt free end 26A is threaded through the second passageway of the second rappelling strap and may then be secured about the wearer's waist by engaging the eyelets in the waist buckle. The positioning pad more firmly places the harness about the person's waist for additional comfort and means of securement. The positioning pad also enables the distribution of the person's weight over a greater surface area to increase comfort and provide a more secure fit.

Figure 6:
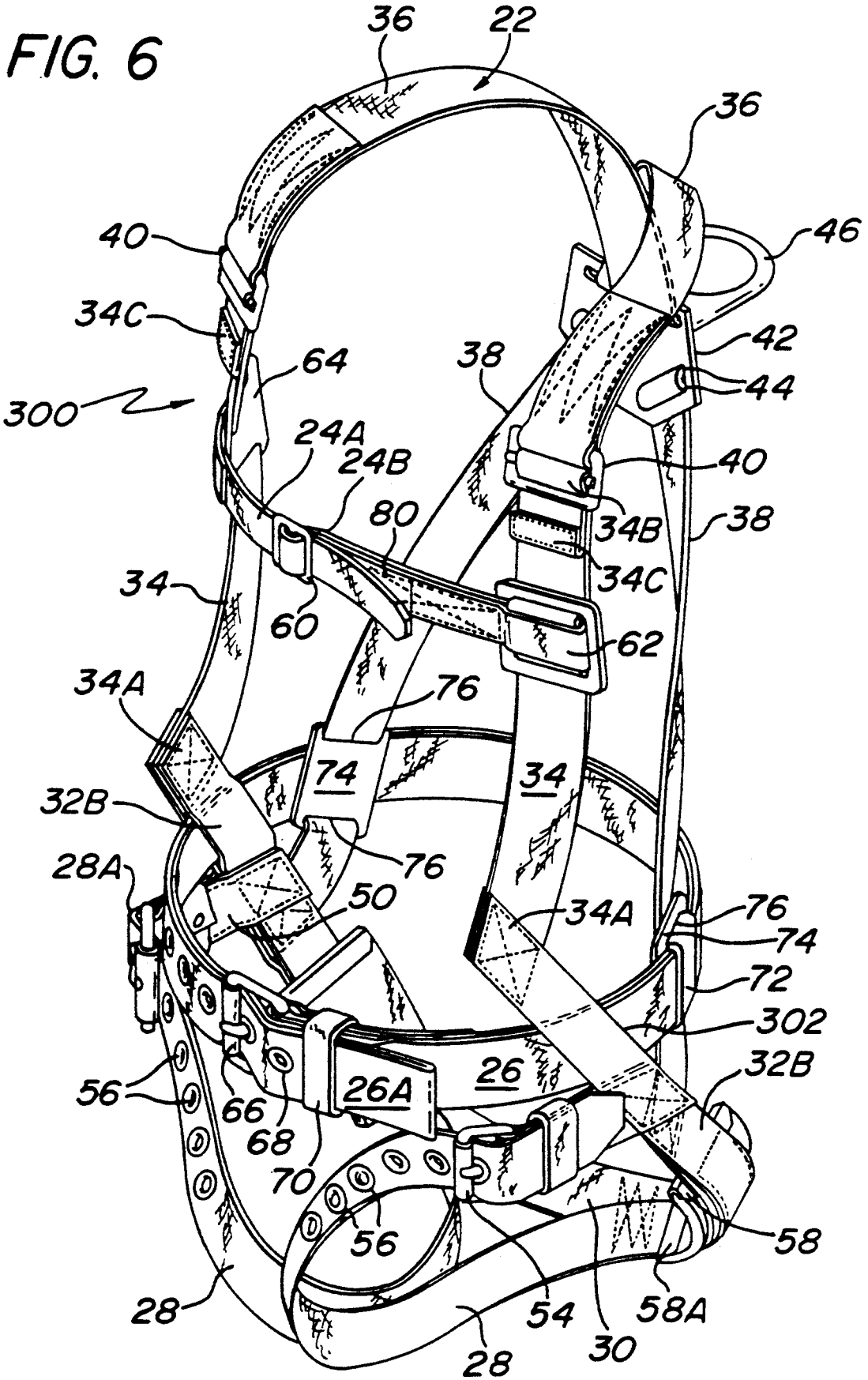
FIG. 6 is an orthogonal view of a third embodiment of a harness constructed in accordance with this invention.
Figure 7:
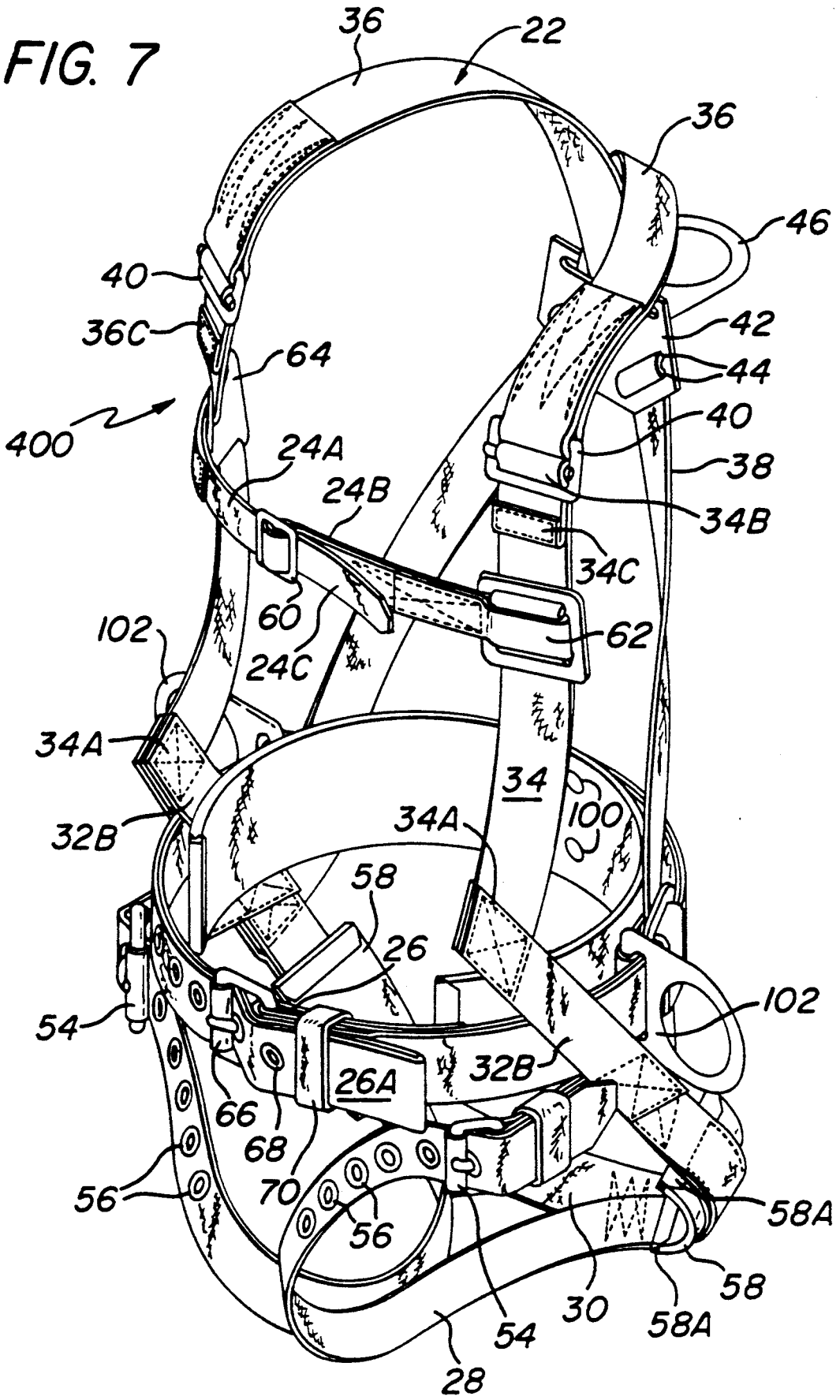
FIG. 7 is an orthogonal view of a fourth embodiment of a harness constructed in accordance with this invention.

In some usage applications for the harnesses of this invention it may not be necessary or desirable to utilize any rappelling straps. Accordingly, the subject invention includes harnesses 300 and 400 of FIGS. 6 and 7, respectively, which do not include rappelling strap portions 32. In particular, the embodiment of harnesses 300 and 400 shown in FIGS. 6 and 7, respectively, are identical to the harnesses 20 and 200 shown in FIGS. 1 and 3, respectively, except that harnesses 300 and 400 do not include any extendable/retractable rappelling strap portions 32. Thus, the details of the harnesses 300 and 400 will not be reiterated in the interest of brevity. Also in that interest common reference numerals are used with respect to common parts in the embodiments 20/300 and 200/400.

One bit of explanation of the structure of harnesses 300 and 400 is deemed necessary herein. In particular, each embodiment 300 and 400 includes the heretofore identified pair of webs 32B and 32C which are sewn together along most of their length except for a portion forming a passageway therebetween. It is this passageway 302 through which the waist strap 26 extends in a similar manner as described earlier with respect to harnesses 20 and 200. However, unlike the harnesses 20 and 200 each of the webs 32B and 32C of the harnesses 300 and 400 terminate at their upper ends 32A in a sewn joint at the bottom 34A of the chest straps 34. Accordingly, no portion of the sewn together webs 32B and 32C of embodiments 300 and 400 extend beyond their juncture with the bottom of the chest straps 34 to form rappelling strap portions 32, like in the embodiments 20 and 200. Moreover, since no extendable/retractable rappelling straps are used in these embodiment, there is no need to utilize the heretofore identified VELCRO components 84 and 86 to releasably hold the rappelling strap portions 32 in the retracted position.

Figure 8:
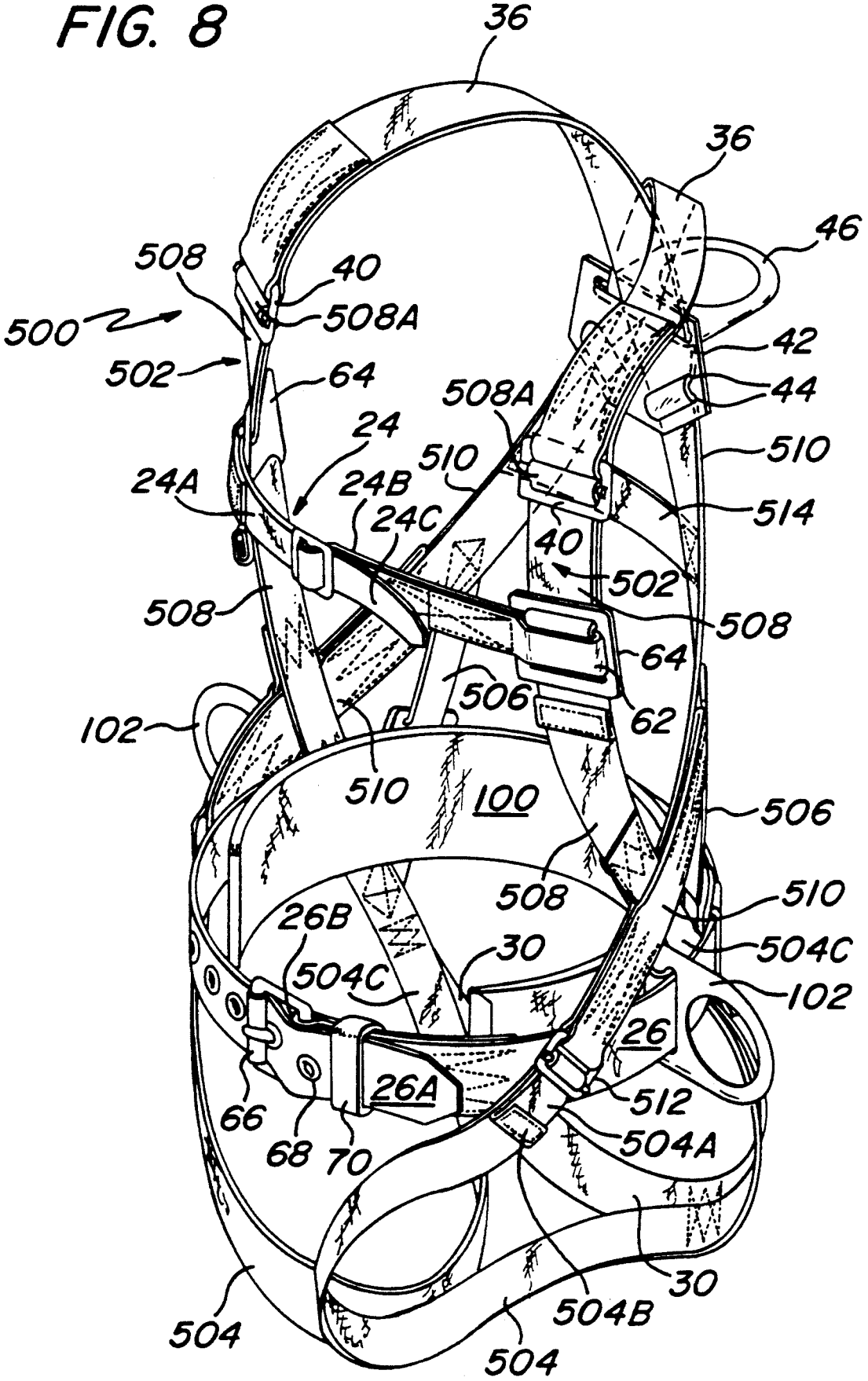
FIG. 8 is an orthogonal view of a fifth embodiment of a harness constructed in accordance with this invention.

Referring now to FIG. 8 the details of a harness 500 having means to adjust the height of its waist belt 26 will now be considered. The harness 500 includes many of the features of the previously described harnesses, and thus such features are given the same reference numbers and the details thereof will not be reiterated in the interest of brevity. Thus, as can be seen in FIG. 8 the harness 500 is formed of a high-strength woven plastic or other type material, such as nylon or polyester, which are fixedly secured together, such as by stitching, to form a configuration into which the upper torso and legs of a person (not shown) are held. The harness 500 basically comprises a pair of upper torso straps 502, a chest strap 24, a waist belt 26, a pair of leg straps 504, a seat strap 30, and a pair of waist belt positioning straps 506. Each of the upper torso straps 502 include three portions, namely a chest side-strap portion 508, a shoulder strap portion 36, and a back strap portion 510. Each chest side-strap portion 508 comprises a vertically extending upper section arranged to extend vertically adjacent a respect side of the wearer's chest when the harness is worn and a lower section angling rearward to the side of the harness for securement to an associated rear strap portion 510 also located that side of the harness 500 (as will be described later).

The upper end of each chest section 508 is secured via a buckle 40 to the front end of an associated shoulder strap 36. In particular, the upper end of each chest side-strap section 508 terminates in a free end 508A which is folded over itself and sewn. Each free end 508A is arranged to be received within a buckle 40 secured to an associated shoulder strap portion 36, enabling the buckle 40 to adjust the chest side-strap section 508.

Each shoulder strap portion 36 extends over a respective shoulder of the wearer and merges into an associated back strap portion 510. In fact, in accordance with the preferred embodiment of this invention, each shoulder strap portion 36 and associated back strap portion 510 is formed as an integral unit of a web of the flexible material.

Figure 9:
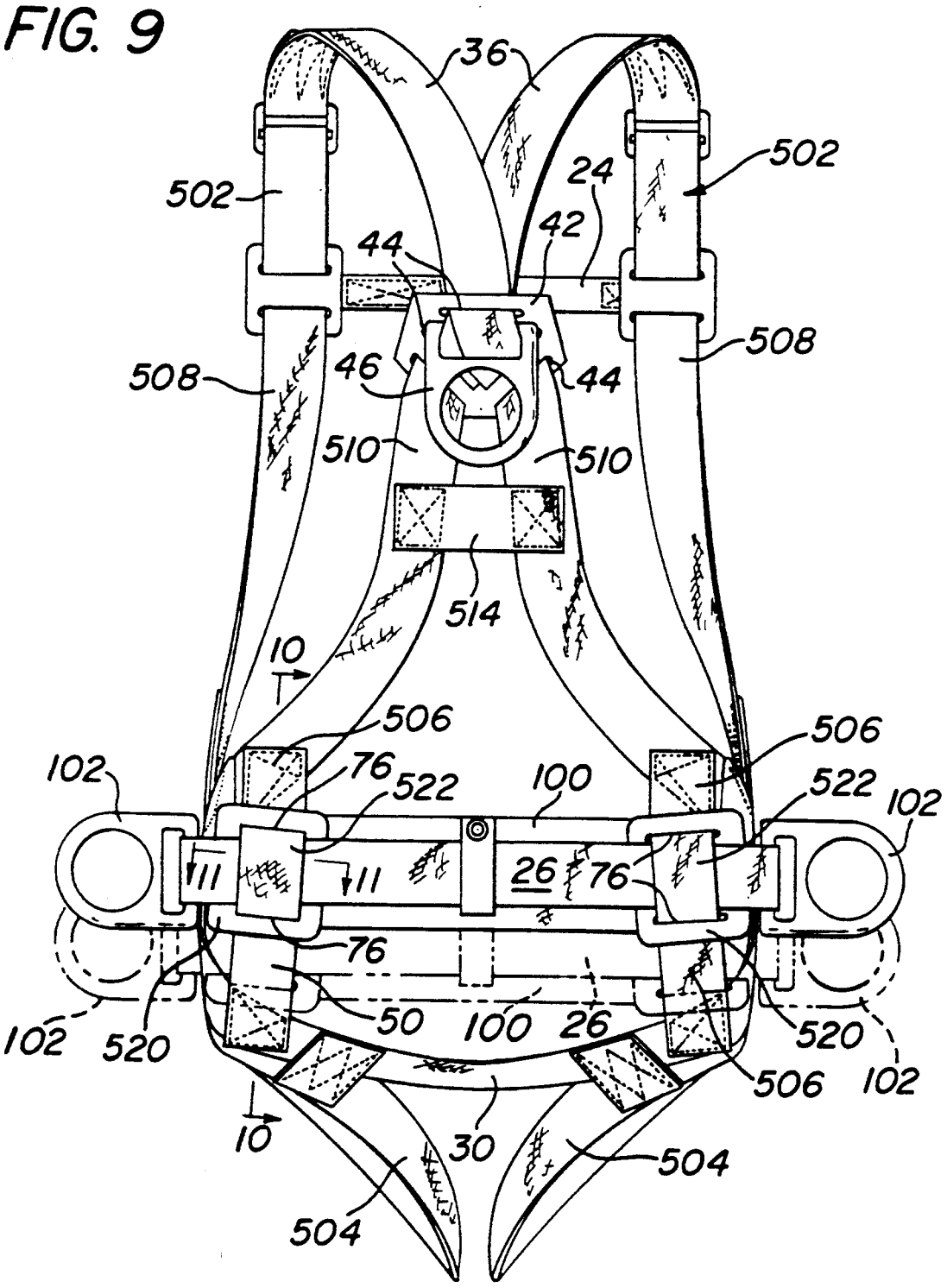
FIG. 9 is an rear view of the embodiment of FIG. 8.
Figure 11:
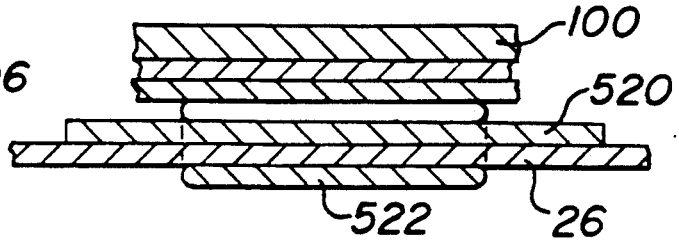
FIG. 11 is an enlarged, sectional view taken along line 11—11 of FIG. 9.
Figure 10:
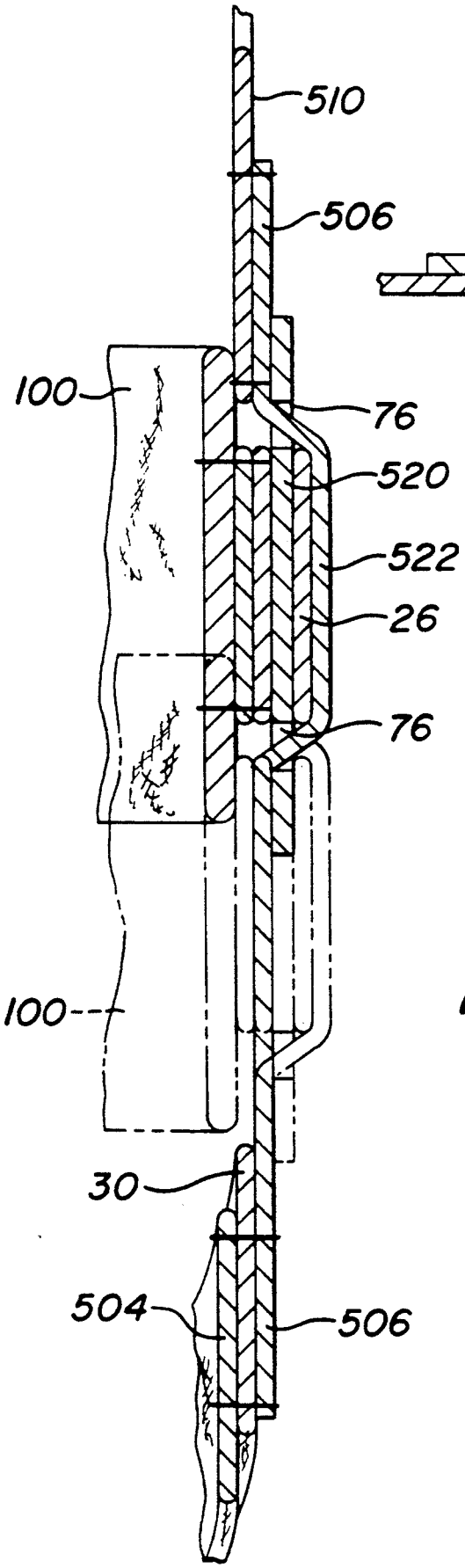
FIG. 10 is an enlarged, sectional view taken along line 10—10 of FIG. 9.

The two back strap portions 510, extend through a cross-buckle 42, formed of any suitable strong material, such as leather or plastic, and having slots 44 therein through which the straps 510 extend and criss-cross in an X-like configuration in the center of the wearer's back, and then extend downward somewhat vertically for a short distance from which they diverge outward laterally as shown in FIG. 9 so that each crosses over the side of the harness at terminates at its lower end in the front of the harness. A horizontally disposed holding strap 514 is secured, e.g., sewn, between the rear straps 510 immediately below the cross buckle 44 to hold them in a somewhat vertical orientation, until they diverge outward for extension around the side of the harness to the front thereof as shown in FIG. 9.

The lower end of each of the chest-side portions 508 are of double web thickness. So too, the lower end of each of the rear straps 510 are also of double web thickness. The double web lower end of the portions 508 cross over and are interleaved with the double web of the lower end of portions 510 and are sewn together on opposite sides thereof by plural lines of stitches as shown in FIG. 8. Moreover, the double web forming the lower end of each rear strap portion 510 below the point at which it is sewn to the lower end of the chest-side portion 508 is folded over itself to mount a buckle 512 thereon. Each buckle 512 serves as the means for connecting one end of an associated leg strap 504 to the lower end of the rear strap portion 510. In particular, the end portion 504A of each leg strap 504 is threaded through an associated buckle 512 on the bottom of an associated rear strap portion 510, as shown in FIG. 8. In order to prevent that end from accidentally falling out of the buckle, the free end 504B of the end portion 504A is folded over itself and sewn in place to form a multiple thickness end. The other end 504C of each of the leg straps 504 is fixedly secured, e.g., sewn, onto the lower portion of an associated chest-side strap portion 508 where it crosses over the rear strap portion 510, i.e., on the side of the harness 500. The seat strap 30 is secured between the leg straps 504 in the same manner as described with reference to FIG. 1.

The waist belt positioning straps 506 are best seen in FIG. 9. As can be seen therein each strap 506 comprises a short web of the same material as forming the remainder of the harnesses 500. The upper end 506A of each strap 506 is fixedly secured, e.g., sewn, onto the lower portion of an associated strap portion 510 as it commences turning toward the outside of the harness. The lower end 506B of each strap 506 is fixedly secured, e.g., sewn, onto an upper portion of an associated leg strap 504 slightly outside of where that associated leg strap is secured to an associated end of the seat strap 30. Thus, both of the waist belt positioning straps 506 are oriented vertically and lie adjacent the two sides at the rear of the harness. Each strap 506 includes slide 520 mounted thereon. These slides are constructed in the same manner as the slides 72 described heretofore. Thus, the straps 506 are threaded through the slots 76 in the two slides 520 to form respective loops 522. The waist belt 26 is threaded between each loop 522 and its associated underlying slide 72, to thereby secure the waist belt 26 to the slide adjusting straps 506, and hence to the harness 500 itself.

As should be appreciated by those skilled in the art the waist belt 26 can be readily slid from the lower buttocks supporting position shown by phantom lines in FIG. 9, to the upper, waist encircling position shown by the solid lines in that Figure. In fact the waist belt can be readily slid to any intermediate position in the interests of comfort. Thus, when the waist belt is in the lower position, the harness is particularly suited for supporting a worker in an non-upright position, e.g., the worker can lean back from a telephone pole, since the worker's weight will be borne by his/her buttocks and not the small of his/her back. If, however the worker is to be oriented upright the waist belt can be readily slid up to encircle the worker's waist.

Figure 12:
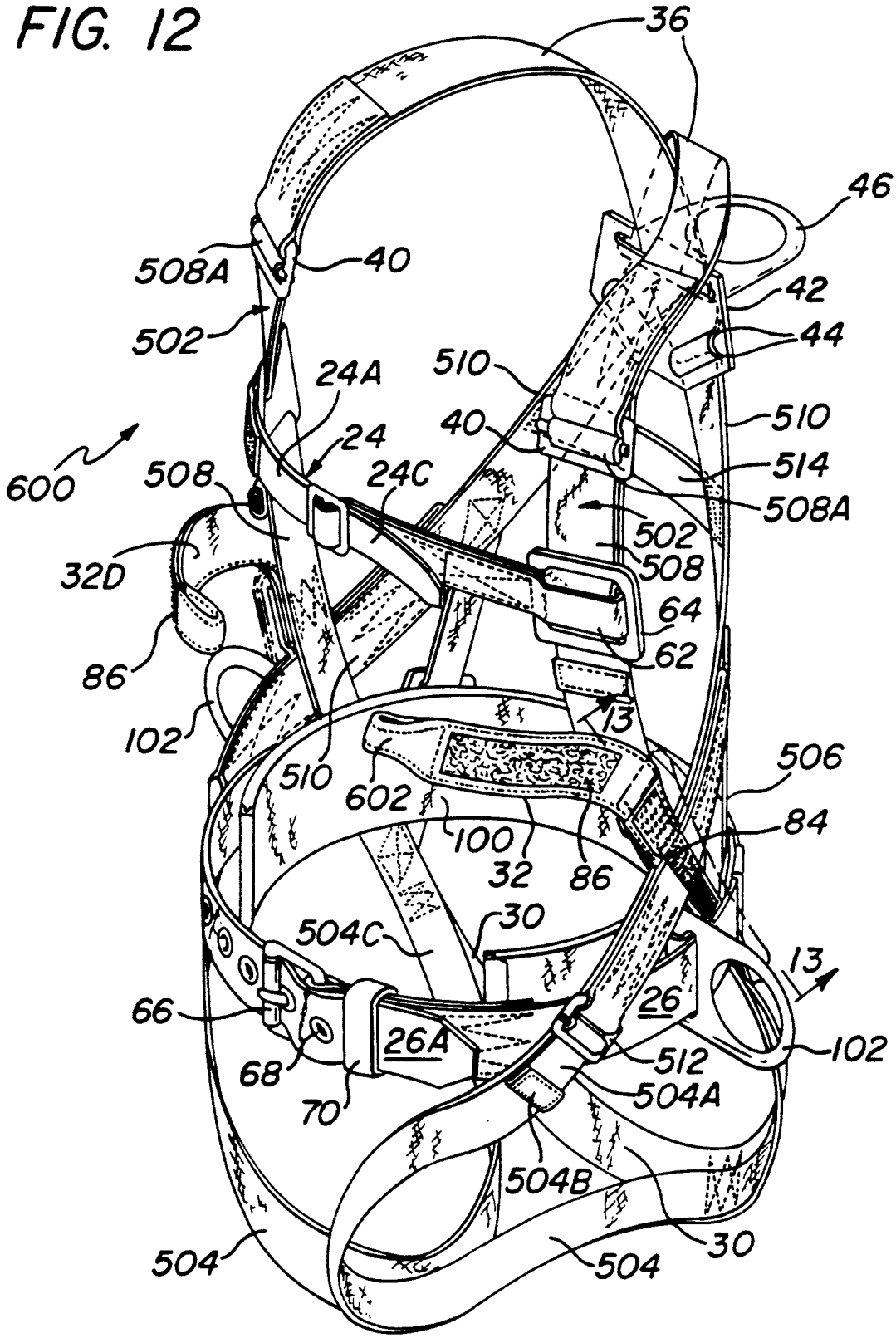
FIG. 12 is an orthogonal view of a sixth embodiment of a harness constructed in accordance with this invention.
Figure 13:
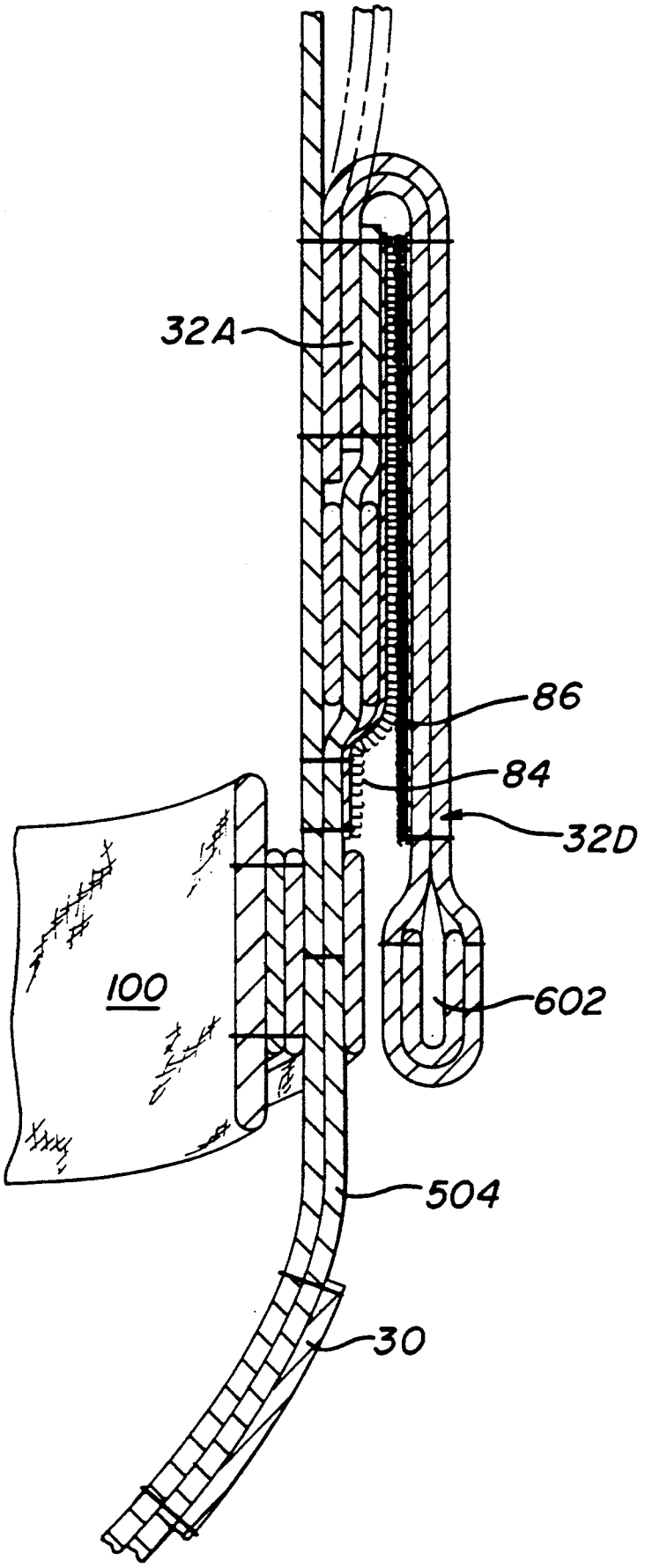
FIG. 13 is an enlarged, sectional view taken along line 13—13 of FIG. 12.

In FIG. 12 there is shown an alternative harness 600. This harness is virtually identical to the harness 500 just described except that it includes a pair of retractable/extendable rappelling strap portions 32 similar in most respects to those described with reference to embodiments 20 and 200. Thus, the same reference numbers for the common components will be used and no further discussion of the construction details of the harness 600 will be made. Suffice it for now to state that the rappelling strap portions 32 are basically constructed in the same manner as described heretofore, except that their free ends 602 are in the form of respective loops of the web material making up the extending portions 32, in lieu of using D-rings 48 (such as used in the harnesses 20 and 200). Moreover, the free ends 602 of the extending portion 32 are of reduced width and increased thickness, (they are folded in two) to facilitate securement of the rappelling straps loop portions 602 to some safety means, e.g., a rope grab or lowering device. In all other respects, the rappelling strap portions 34D are constructed and used in the same manner as described heretofore with reference to harnesses 20 and 200.

The waist belt height adjustment straps 506 and associated components of the harness 600 are constructed in the same manner and are operated in the same manner as just described with reference to harness 500.

Without further elaboration the foregoing will so fully illustrate my invention that others may, by applying current or future knowledge, adapt the same for use under various conditions of service.

I claim:

1. A harness formed of a flexible material to be worn by a person, said harness including a waist belt, a pair of upper torso straps, a pair of leg straps, each of said upper torso straps including a chest strap portion for extending over a portion of the chest of the person, a shoulder strap portion for extending over a respective shoulder of the person, and a back strap portion for extending over a portion of the back of the person, wherein said waist belt is connected to each of the back strap portions by respective sliding connector means, each of said leg straps for extending about a respective leg of the person and terminating at an upper end portion, each of the upper end portions of said leg straps including a passageway through which said waist belt extends.

2. The harness of claim 1 wherein said waist belt comprises means for holding at least one tool thereon.

3. The harness of claim 2 wherein said waist belt is connected to each of the back strap portions by respective sliding connector means.

4. The harness of claim 3 wherein each of said sliding connector means is arranged to slide with respect to said back strap portion and with respect to said waist belt.

5. The harness of claim 2 wherein said means for holding a tool on said waist belt is positionable along said waist belt.

6. The harness of claim 1 wherein each of said sliding connector means is arranged to slide with respect to said back strap portion and with respect to said waist belt.

7. The harness of claim 1 additionally comprising a positioning pad for releasable securement to said waist belt.

8. The harness of claim 7 wherein said waist belt is formed of a web of flexible material, and wherein said positioning pad comprises a web of flexible material which is wider than said waist belt.

9. The harness of claim 8 wherein said positioning pad comprises a pair of D-rings fixedly secured thereto, each of said D-rings including an opening therein through which said waist belt extends to hold said positioning pad on said waist belt.

10. A harness formed of a flexible material to be worn by a person, said harness including a waist belt a pair of upper torso straps, a pair of leg straps, and a pair of waist belt positioning straps, each of said upper torso straps including a chest strap portion for extending over a portion of the chest of the person, a shoulder strap portion for extending over a respective shoulder of the person, and a back strap portion for extending over a portion of the back of the person, each of said leg straps for extending about a respective leg of the person, one of said leg straps being connected between a first one of the back strap portions and a first one of the chest strap portions, the other one of said leg straps being connected between a second one of said back strap portions and a second one of said chest strap portions, one of said positioning straps being connected in a generally vertical orientation between a first one of said back strap portions and a first one of said leg straps, the other of said positioning straps being connected in a generally vertical orientation between a second one of said back strap portions and a second one of said leg straps, said waist belt being coupled to said positioning straps and being slidable thereon so that the position of said waist belt at the rear of said harness can be adjusted to a desired height.

11. The harness of claim 10 additionally comprising first and second sliding connector means mounted on respective ones of said waist belt positioning straps, said sliding connector means slidably coupling said waist belt to said waist belt positioning straps.

12. The harness of claim 10 additionally comprising a pair of extendable rappelling straps.

13. The harness of claim 12 wherein said rappelling straps are connected to respective ones of said leg straps.

14. The harness of claim 10 additionally comprising a positioning pad for releasable securement to said waist belt.

15. The harness of claim 14 wherein said waist belt is formed of a web of flexible material, and wherein said positioning pad comprises a web of flexible material which is wider than said waist belt.

16. The harness of claim 15 wherein said positioning pad comprises a pair of D-rings fixedly secured thereto, each of said D-rings including an opening therein through which said waist belt extends to hold said positioning pad on said waist belt.

17. The harness of claim 14 additionally comprising a pair of extendable rappelling straps.

18. A harness formed of a flexible material to be worn by a person, said harness including a waist belt, a pair of upper torso straps, a pair of leg straps, and rappelling means comprising at least one strap having a first end fixedly secured to said harness and a second end which can be readily moved from a retracted position to an extended position, wherein when said at least one strap is in said retracted position said at least one strap does not interfere with the activities of said person, and wherein when said at least one strap is in said extended position said at least one strap permits said person to easily connect said second end of said strap to a support means, each of said upper torso straps including a chest strap portion for extending over a portion of the chest of the person, a shoulder strap portion for extending over a respective shoulder of the person, and a back strap portion for extending over a portion of the back of the person, each of said leg straps for extending about a respective leg of the person and terminating at an upper end portion, each of the upper end portions of said leg straps including a passageway through which said waist belt extends.

19. The harness of claim 18 wherein said waist belt comprises means for holding at least one tool thereon.

20. The harness of claim 19 wherein said means for holding a tool on said waist belt is positionable along said waist belt.

21. The harness of claim 18 wherein said waist belt is connected to each of the back strap portions by respective sliding connector means.

22. The harness of claim 21 wherein each of said sliding connector means is arranged to slide with respect to said back strap portion and with respect to said waist belt.

23. The harness of claim 18 additionally comprising a positioning pad for releasable securement to said waist belt.

24. The harness of claim 23 wherein said waist belt is formed of a web of flexible material, and wherein said positioning pad comprises a web of flexible material which is wider than said waist belt.

25. The harness of claim 24 wherein said positioning pad comprises a pair of D-rings fixedly secured thereto, each of said D-rings including an opening therein through which said waist belt extends to hold said positioning pad on said waist belt.

* * * * *